United States Patent [19]

Sisk, Jr.

[11] 4,254,311

[45] Mar. 3, 1981

[54] LIQUID LEVEL CONTROL

[75] Inventor: George W. Sisk, Jr., Evansville, Ind.

[73] Assignee: Whirlpool Corporation, Benton Harbor, Mich.

[21] Appl. No.: 38,573

[22] Filed: May 14, 1979

[51] Int. Cl.[3] ..... H01H 35/42; F25D 21/00

[52] U.S. Cl. ..... 200/61.07; 200/85 R; 62/150

[58] Field of Search ..... 200/61.04, 61.06, 61.07, 200/85 R, 61.7, 61.2

[56] References Cited

U.S. PATENT DOCUMENTS

| | | | |
|---|---|---|---|
| 2,843,693 | 7/1958 | Scriver | 200/61.07 |
| 2,879,708 | 3/1959 | Cripe | 200/61.07 X |
| 2,956,417 | 10/1960 | Lyman | 62/150 |
| 3,500,654 | 3/1970 | Sholtes | 62/150 |

*Primary Examiner*—James R. Scott

*Attorney, Agent, or Firm*—Wegner, Stellman, McCord, Wood & Dalton

[57] ABSTRACT

A liquid level control wherein a receptacle for collecting liquid is carried on a support for movement in accordance with the weight of the liquid collected therein. A switch is mounted adjacent the receptacle so as to be actuated as an incident of movement of the receptacle. A control is provided which is adjustably retained on the support adjacent the receptacle to provide a selectively adjustable resistance to movement of the receptacle whereby the weight of the collected liquid necessary to actuate the switch may be selectively adjusted. The control is arranged to be fail-safe in that should the control loosen, actuation of the switch is effected by a minimum weight of collected liquid in the receptacle.

10 Claims, 5 Drawing Figures

FIG. 1
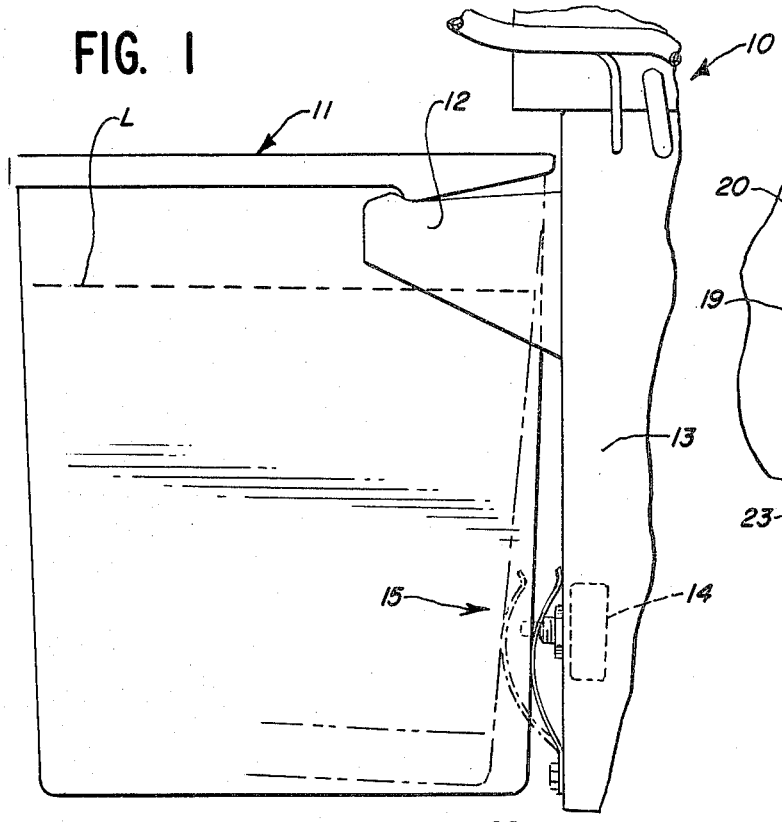
FIG. 2
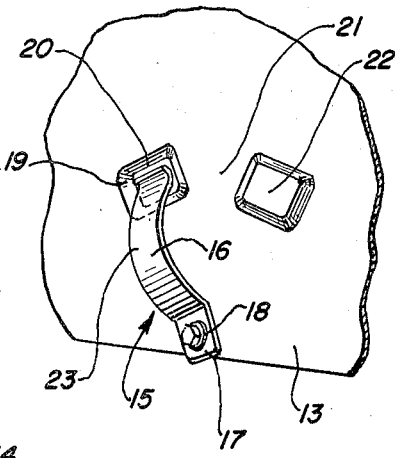
FIG. 3
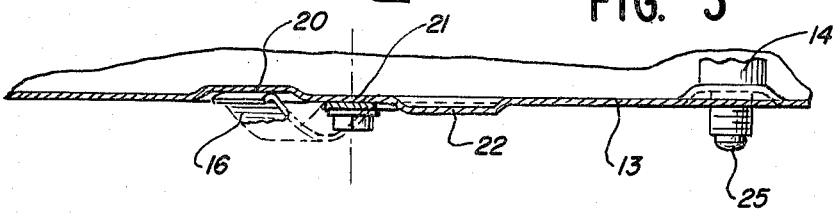
FIG. 5
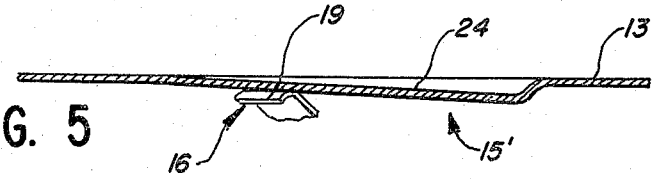
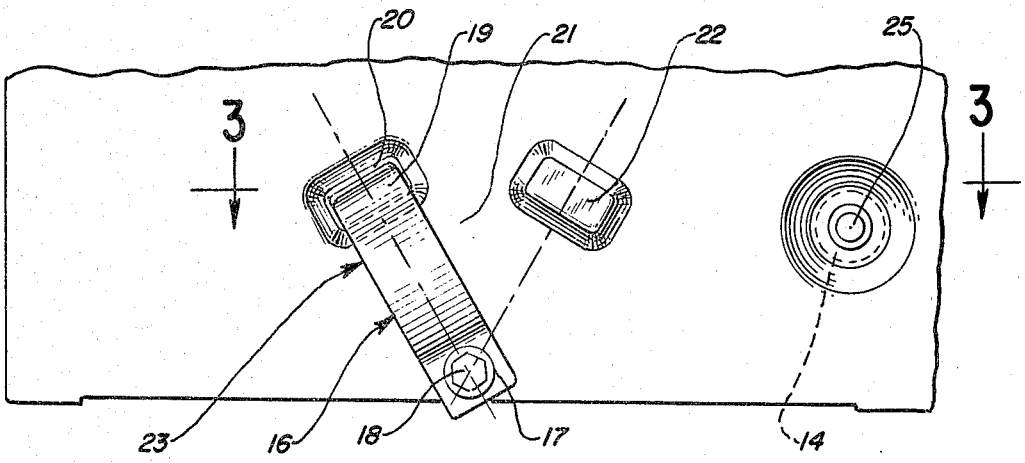
FIG. 4

LIQUID LEVEL CONTROL

BACKGROUND OF THE INVENTION

1. Field of the Invention

This invention relates to liquid level controls and in particular to controls for varying the level of collected liquid in a receptacle, such as the bucket of a dehumidifier.

2. Description of the Prior Art

In the conventional dehumidifier, a receptacle, or bucket, is provided for collecting the water removed from the atmosphere. One example of such a collecting means is shown in Edmund E. Weschler, Jr. U.S. Pat. No. 2,759,335. As shown therein, a pivot is provided for supporting the bottom of the receptacle to allow it to tilt as a result of liquid flowing over a barrier into a second compartment of the receptacle.

Gene H. Cripe, in U.S. Pat. No. 2,879,708, shows a grease accumulator for use in a kitchen stove wherein the receptacle for collecting the grease is hung on a pivotal arm which has one end adjustably spring-biased so as to control the operation of an associated control switch.

Wallace R. Lyman, in U.S. Pat. No. 2,956,417, shows a dehumidifying apparatus having a removable receptacle which is hung so as to swing against a plate which is adjustably spring-biased for controlling an operating switch of the dehumidifier.

Carl E. Sholtes shows a dehumidifier structure in U.S. Pat. No. 3,500,654 wherein the receptacle is pivotally mounted to swing against a spring which is adjusted by a threaded member so as to provide a variable resisting force against the wall of the bucket.

SUMMARY OF THE INVENTION

The present invention comprehends an improved apparatus for controlling the collection of liquid in a receptacle, such as the bucket of a dehumidifier, wherein the control means is constructed to permit actuation of the control switch with a minimum weight of collected liquid in the receptacle in the event the control means fails to be retained in the selected position as by loosening of the mounting of the control means on the support means.

In the illustrated embodiment, the control means includes a leaf spring which is secured to the mounting support at a lower end so that loosening of the screw clamping the lower end of the spring to the mounting support will permit the spring to swing downwardly and thereby permit actuation of the control switch with a minimum weight of water in the collecting bucket.

The leaf spring may be selectively positioned so as to provide selective adjustable resistance to the movement of the receptacle for controlling the actuation of the control switch. In one form, the leaf spring end portion is selectively receivable in a recess in the support means, on an intermediate wall portion of the support means, or on a projecting boss of the wall portion so as to provide discrete, preselected adjustments of the resistance to the bucket movement. In another form, the support means defines a ramp which provides an infinite adjustment of the resistance to movement of the bucket in controlling the operation of the switch.

As indicated above, the leaf spring includes a mounting portion which is clamped to the support means by a suitable screw. The mounting portion effectively defines a lower portion of the leaf spring so that should the clamping screw loosen, the leaf spring can swing downwardly out of the path of movement of the bucket to permit minimum weight of the bucket to effect operation of the control switch.

Thus, the liquid level control of the present invention is extremely simple and economical of construction while yet providing the highly desirable fail-safe functioning and other features discussed above.

BRIEF DESCRIPTION OF THE DRAWING

Other features and advantages of the invention will be apparent from the following description taken in connection with the accompanying drawing wherein:

FIG. 1 is a fragmentary side elevation of a dehumidifier apparatus having a liquid level control embodying the invention;

FIG. 2 is a fragmentary perspective view of the control means for selectively resisting movement of the bucket to effect actuation of the control switch;

FIG. 3 is a fragmentary horizontal section taken substantially along the line 3—3 of FIG. 4.

FIG. 4 is a fragmentary elevation of the control means; and

FIG. 5 is a fragmentary section similar to that of FIG. 3, but illustrating a modified form of control means embodying the invention.

DESCRIPTION OF THE PREFERRED EMBODIMENT

In the exemplary embodiments of the invention as disclosed in the drawing, a liquid collecting apparatus generally designated 10 is shown to comprise a dehumidifier apparatus having a receptacle, or bucket, 11 which may be pivotally supported by suitable brackets 12 mounted to a support 13 of the dehumidifier. As indicated above, bucket 11 is arranged to receive condensate removed from the atmosphere in the operation of the dehumidifier. It is desirable to provide, in such a dehumidifier, a control for discontinuing dehumidifying operation of the apparatus when the level of the condensate reaches a preselected upper level in the bucket 11.

Illustratively, as shown in FIG. 1, the dehumidifier may be provided with a switch 14 for controlling operation of the dehumidifier. A control generally designated 15 is provided for effecting selective adjustable resistance to movement of the bucket so as to provide adjustable operation of the switch 14 by the weight of the bucket. Thus, in the illustrated embodiment, control means 15 is arranged to provide actuation of switch 14 when the level of condensate reaches the level L in the bucket 11 so as to discontinue further operation of the dehumidifier until such time as the collected condensate is removed.

Control means 15 comprises means adjustably retained in any one of a plurality of positions on the support 13 while providing selective adjustable resistance to the movement of receptacle 11 whereby the weight of the collected liquid necessary to actuate the switch may be selectively adjusted. In the illustrated embodiment, the control means is defined by a bowed leaf spring 16 having a lower end portion 17 clamped to the support 13 by suitable screw 18.

The distal end 19 of the spring selectively contacts spacing means on the support 13, herein shown as a recess 20 thereof, a midportion 21 thereof, or a raised boss 22 thereon. By selectively positioning the leaf spring in any one of the three selectable, angularly spaced, positions, the bowed engagement portion 23 thereof is caused to extend more or less from the support 13, thereby providing adjustable resistance to the movement of the receptacle by the weight of the collected condensate therein.

Alternatively, as shown in FIG. 5, the control means may comprise a modified form of control 15' wherein the adjustment of the disposition of the spring 16 may be an infinite adjustment in lieu of the discrete adjustability of the embodiment of FIGS. 2 and 3. Thus, as shown in FIG. 5, the support wall 13 may be provided with a ramp portion 24 along which the distal end 19 of the spring 16 may be moved to provide the infinite adjustability of the spring positioning.

Switch 14 may be carried on the support wall 13 to one side of the control means 15 and may include an actuator button 25 extending forwardly from the support wall so as to be engaged by a portion of the bucket 11 laterally of the portion engaging spring 16.

As discussed above, the invention comprehends an improved control means 15 wherein loosening of the control provides a fail-safe function. More specifically, as best seen in FIGS. 2 and 4, should the screw 18 loosen so as to permit movement of the spring 16, the weight of the spring will cause it to swing by gravity downwardly about the axis of screw 18 so as to be moved to a position which permits the bucket to actuate switch 14 with a minimum weight of liquid in the bucket. Spring 16 may, for example, be disposed so as to swing downward completely out of the path of the bucket under such a failure condition.

The bowed portion 23 of spring 16 provides a resilient resistance to the swinging of the bucket. The positioning of the spring is readily effected by simply removing distal end 19 from recess 20 and rotating the spring about the axis of clamping screw 18 to the desired new position. Similarly, in moving the distal end 19 onto the boss 22, the resiliency of bowed engagement portion 23 permits the end 19 to be moved outwardly so as to be brought onto the outer surface of the boss.

The arrangement of FIG. 2 providing discrete adjustments of the spring provides discrete different levels of collected water in the bucket for terminating operation of the dehumidifier. As indicated above, the modified form of the invention illustrated in FIG. 5 permits infinite adjustment of the control means for further facilitated adjustment of operation of the dehumidifier when desired.

The control means is extremely simple and economical of construction while yet providing the fail-safe operation and facilitated adjustment discussed above.

The foregoing disclosure of specific embodiments is illustrative of the broad inventive concepts comprehended by the invention.

Having described the invention, the embodiments of the invention in which an exclusive property or privilege is claimed are defined as follows:

1. In an apparatus for collecting liquid having a receptacle for collecting the liquid, pivot means supporting the receptacle for movement thereon in accordance with the weight of liquid collected in the receptacle, support means, and a switch mounted to the support means adjacent the receptacle for actuation as an incident of movement of the receptacle, the improvement comprising:

control means movably mounted on the support means adjacent said receptacle; and means for causing said control means to be adjustably retained in any one of a plurality of preselected spaced positions on the support means to be engaged by said receptacle and provide selective adjustable resistance to pivotal movement of the receptacle whereby the weight of collected liquid necessary to actuate said switch may be selectively adjusted, said control means being constructed to permit actuation of said switch unimpededly by said receptacle in the event said control means fails to be retained in the selected position as by loosening of the mounting of the control means on said support means.

2. The liquid collecting apparatus of claim 1 wherein said control means comprises a leaf spring having a mounting portion and an engaging portion, and clamping means adjustably clamping said mounting portion to retain said engaging portion above said mounting portion, movement of said receptacle being resisted by engagement thereof with said engaging portion.

3. The liquid collecting apparatus of claim 1 wherein said control means comprises a leaf spring having a mounting portion and an engaging portion, and clamping means adjustably clamping said mounting portion to retain said engaging portion above said mounting portion, movement of said receptacle being resisted by engagement thereof with said engaging portion, said support means having means selectively engaged by said spring for adjustably positioning said spring engaging portion in any one of a plurality of different positions in the direction of movement of said receptacle.

4. The liquid collecting apparatus of claim 1 wherein said control means comprises a leaf spring having a mounting portion and an engaging portion, and clamping means adjustably clamping said mounting portion to retain said engaging portion above said mounting portion, movement of said receptacle being resisted by engagement thereof with said engaging portion, said support means having means selectively engaged by said spring for adjustably positioning said spring engaging portion in any one of a plurality of different discrete positions in the direction of movement of said receptacle.

5. In an apparatus for collecting liquid having a receptacle for collecting the liquid, pivot means supporting the receptacle for movement thereon in accordance with the weight of liquid collected in the receptacle, support means, and a switch mounted to the support means adjacent the receptacle for actuation as an incident of movement of the receptacle, the improvement comprising control means adjustably retained in any one of a plurality of angularly spaced positions on the support means for providing selective adjustable resistance to movement of the receptacle whereby the weight of collected liquid necessary to actuate said switch may be selectively adjusted, said control means being constructed to permit actuation of said switch with minimum weight of collected liquid in said receptacle in the event said control means fails to be retained in the selected position as by loosening of the mounting of the control means on said support means, said control means comprising a leaf spring having a mounting portion and an engaging portion, and clamping means adjustably clamping said mounting portion to retain said engaging portion above said mounting portion, movement of said receptacle being resisted by engagement thereof with said engaging portion, said support means having stepped shoulders selectively engaged by a distal portion of said spring for adjustably positioning said spring engaging portion in any one of a plurality of different discrete positions in the direction of movement of said receptacle.

6. The liquid collecting apparatus of claim 1 wherein said control means comprises a leaf spring having a mounting portion and an engaging portion, and clamping means adjustably clamping said mounting portion to retain said engaging portion above said mounting portion, movement of said receptacle being resisted by engagement thereof with said engaging portion, said support means having a ramp engaged by said spring for adjustably positioning said spring engaging portion in an infinite plurality of different positions in the direction of movement of said receptacle.

7. The liquid collecting apparatus of claim 1 wherein said control means comprises a leaf spring having a mounting portion and an engaging portion, and clamping means pivotally securing said mounting portion to said support so as to permit selective angular adjustment of said spring in a plane generally perpendicular to the movement of said receptacle, such angular adjustment of said spring effecting movement of said engagement portion in the direction of movement of said receptacle.

8. In a liquid collecting apparatus having a vertical support, a liquid collecting receptacle disposed adjacent said support, means for pivotally mounting said receptacle for movement toward said support in accordance with the weight of liquid collected in said receptacle, and a switch mounted on said support adjacent said receptacle for actuation by said receptacle, an improved means for permitting selective adjustment of the weight of collected liquid required to effect actuation of said switch comprising:

a leaf spring interposed between said receptacle and said support, said spring having a mounting portion pivotally mounted to said support about an axis generally parallel to the direction of movement of said receptacle, an intermediate engagement portion extending toward said receptacle for engagement therewith, and a distal portion contacting said support at any one of a plurality of angularly spaced locations at or above the level of said spring mounting axis; and spacing means on said support at at least one of said plurality of angularly spaced locations for selectively positioning said distal spring portion in the direction of movement of said receptacle.

9. The liquid collecting apparatus of claim 8 wherein said spacing means comprises a flat surface at said level of the spring mounting portion, a recess extending to below said level, and a raised boss extending above said level.

10. In a liquid collecting apparatus having a vertical support, a liquid collecting receptacle disposed adjacent said support, means for pivotally mounting said receptacle for movement toward said support in accordance with the weight of liquid collected in said receptacle, and a switch mounted on said support adjacent said receptacle for actuation by said receptacle, an improved means for permitting selective adjustment of the weight of collected liquid required to effect actuation of said switch comprising:

a leaf spring having a mounting portion pivotally mounted to said support to pivot about an axis generally parallel to the direction of movement of said receptacle, and an engagement portion extending toward said receptacle for engagement therewith;

means for retaining said spring in any one of a plurality of pivoted positions; and means on said support for adjustably positioning said engagement portion in different positions above said mounting axis along the direction of movement of said receptacle as a function of the pivoted positioning of said spring so as to provide correspondingly different resistances to movement of said receptacle toward said support, said spring being positioned to permit unimpeded movement of the receptacle toward the support in the event the friction means fails to return said spring in said pivoted positions.

* * * * *